US005278877A

United States Patent [19]

Bodin et al.

[11] Patent Number: 5,278,877

[45] Date of Patent: Jan. 11, 1994

[54] PROCESS FOR DISMANTLING BURIED UNSHELTERED EQUIPMENT WHICH IS AT RISK OF CONTAMINATION AND POSSIBLY IS IRRADIATING, AND A VESSEL FOR IMPLEMENTING THIS PROCESS

[75] Inventors: François Bodin, Equeurdreville; Jean-Claude Saublet, Villeneuve Le Roi, both of France

[73] Assignee: Cogema-Compagnie Generale Des Matieres Nucleaires, France

[21] Appl. No.: 719,792

[22] Filed: Jun. 24, 1991

[30] Foreign Application Priority Data

Jun. 25, 1990 [FR] France ..... 90 07948

[51] Int. Cl.[5] ..... G21C 19/32

[52] U.S. Cl. ..... 376/260; 376/272

[58] Field of Search ..... 376/260, 262, 263, 272; 250/505.1, 506.1, 515.1, 517.1

[56] References Cited

U.S. PATENT DOCUMENTS 3,910,006 10/1975 James ..... 53/37
4,366,114 12/1982 Kühnel et al. ..... 376/272
4,410,802 10/1983 Szulinski ..... 250/515.1
4,439,905 4/1984 Gourdon et al. ..... 376/262
4,681,706 7/1987 Mallory et al. ..... 252/633
4,793,962 12/1988 Tsitsichvili ..... 376/261

FOREIGN PATENT DOCUMENTS 2444137 12/1978 France .
2626923 2/1988 France .

*Primary Examiner*—Donald P. Walsh
*Assistant Examiner*—Frederick H. Voss
*Attorney, Agent, or Firm*—Pearne, Gordon, McCoy & Granger

[57] ABSTRACT

A process for dismantling equipment that is buried, unsheltered, at risk of contamination and possibly is irradiating, and a vessel for implementing this process. According to the invention, buried equipment at risk of contamination, for example, an off-line effluent pipe, is dismantled in sections under cover of a movable vessel (124) placed above the section to be dismantled (12, 14). The invention also concerns a vessel (124) that has a self-supporting structure built around a deck (126) equipped with an elongated central opening (148) giving access to the section to be dismantled (12, 14).

15 Claims, 4 Drawing Sheets

PROCESS FOR DISMANTLING BURIED UNSHELTERED EQUIPMENT WHICH IS AT RISK OF CONTAMINATION AND POSSIBLY IS IRRADIATING, AND A VESSEL FOR IMPLEMENTING THIS PROCESS

BACKGROUND OF THE INVENTION

The invention concerns a process for dismantling buried unsheltered equipment at risk of radioactive contamination, particularly the kind that extends in a straight line, such as shut-down effluent pipes.

As part of a general radioactive-contamination risk protection policy, waste and equipment that may be contaminated must be eliminated when the equipment is taken off line and the areas it occupied must be made available for other uses. Indeed, even when pipes are buried in the ground, they may eventually deteriorate and spread contamination by infiltration and/or irrigation, which is very difficult to contain.

Generally, a state of noncontamination or decontamination means a state in which the radioactivity of a material is below a predetermined threshold, for example, one stipulated by law.

SUMMARY OF THE INVENTION

The invention proposes a dismantling process that meets the requirements of strictness and confinement essential for work in an area potentially subject to radioactivity. More precisely, the invention proposes a process for dismantling unsheltered, buried equipment which is at risk of contamination and is possibly irradiating, characterized by the fact that sections of the equipment are dismantled in units, under the cover of a movable vessel placed above the section to be dismantled.

According to one special method of implementing the process in the invention, after the vessel is put into place, the section to be dismantled is first:

surrounded by a protective envelope; then
disengaged on site in its trench;
separated from the rest of the equipment;
put into the vessel in pieces;
placed in a container that is in the vessel; and
evacuated from the vessel in the container.

Moreover, depending on the radioactivity of the debris and the ditch where the dismantled section was located, any soil whose radioactivity exceeds a predetermined threshold is evacuated from the ditch to an appropriate storage area. One option is terracing to disengage ahead of time the sections to be dismantled after the section presently being dismantled, during which any waste whose radioactivity is higher than a predetermined threshold is stored temporarily in said vessel before it is evacuated to the storage area.

In one variation of the process in the invention, supports for the movable vessel, such as blocks or a support rail are set up on either side of the equipment as the equipment is being dismantled. The vessel is then moved, for example, by crane. This option of setting up temporary supports such as blocks is very advantageous in several respects:

It allows the vessel to be positioned with great precision on spaces or land with reduced access and/or on land where there has been an accident;

It allows work to be done in the ditch without risk of landslide; and

It allows vessel supports to be set up quickly and inexpensively.

The invention also concerns a vessel for implementing various versions of the process described above; the vessel contains:

a self-supporting structure built around a deck that has a central opening; this structure supports various mobile lifting or handling tools and an outside envelope equipped with a handling room and/or at least one window with a movable cover;

a flexible protective curtain located around the central opening to surround the work area where the section being dismantled is located and to isolate it from the outside, leaving the area accessible from the vessel;

a forced ventilation system with a filter to filter out contaminated dust from inside the vessel.

According to one variation of the vessel that is consistent with the invention, the vessel also includes a movable internal cover over the central opening to isolate the inside of the vessel for a period of time from the work area where the section being dismantled is located. Advantageously, the vessel also includes a moving-head-type vacuum device with a filter to pick up dust in that area. In one special embodiment of this variation, the forced ventilation device and the vacuum ventilation device are made so that once the movable inside cover is put in place, the work area is depressed in relation to the inside of the vessel and the inside of the vessel itself is depressed in relation to the outside air.

According to another variation of the vessel that is consistent with the invention, the flexible curtain is composed of a bellows, one end of which is joined to the edges of the central opening and the other end of which bears a rigid framework for housing the bellows when it is retracted. Advantageously, this bellows is maneuvered in extended or retracted position by a lifting device with a winch on the frame.

According to yet another variation of the vessel that is consistent with the invention, two sides of the opening form a rolling path for a cart suspended in the opening. Advantageously, the cart carries a hydraulic scoop.

According to another embodiment of the vessel that is consistent with the invention, the deck has an area for a container accessible from a window with a movable cover located preferably in the part forming the roof of the vessel and, possibly, a work area for the section being dismantled. Advantageously, the deck also has an area for a container of soil accessible from another window with a movable cover located preferably in the part forming the roof of the vessel. As an option, the vessel may include a hopper equipped with a controlled-opening helmet that passes through the outside envelope and comes out above the area for the soil container. This hopper takes the contaminated terracing soil extracted by a hydraulic scoop with closed buckets located on the outside of the vessel. Such an arrangement makes it possible to confine debris from the equipment being dismantled, on one hand, and soil from the ditch and the embankment that may be contaminated.

According to yet another variation of the vessel consistent with the invention, the vessel is constructed around two half-shells assembled so that they can be dismantled on both sides of a vertical median plane, preferably parallel to the largest side of the deck.

According to yet another variation of the vessel consistent with the invention which can be used particularly for dismantling equipment with straight extensions, the central opening is rectangular and is adapted so it can be positioned carefully and aligned with the specific section to be dismantled.

BRIEF DESCRIPTION OF THE DRAWINGS

The invention is now described with reference to the attached drawings in which.

DETAILED DESCRIPTION OF THE PREFERRED EMBODIMENTS

Figure 1:
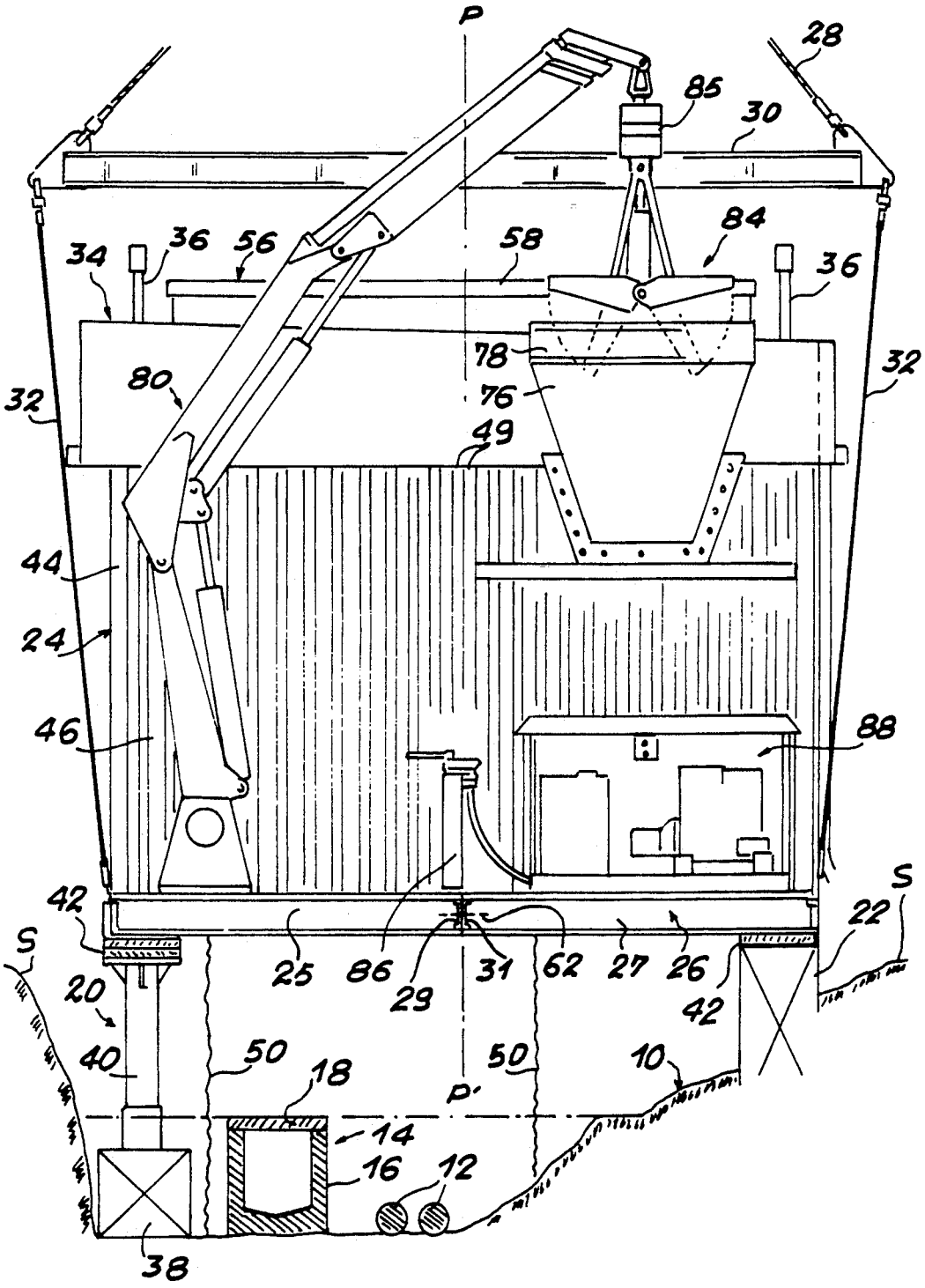
FIG. 1 shows a side view of an initial embodiment of a vessel according to the invention in place above a section to be dismantled, which in turn is seen in transverse section.

In FIG. 1, reference 10 shows an open trench in used soil S to disengage equipment at risk of radioactive contamination and that may be irradiating, said equipment consisting of straight extensions, such as pipes, sluices, sheathing, plumbing, electrical cables, etc. As a non-limiting example of off-line equipment to be dismantled, we have shown a section in FIG. 1 of two metal pipes 12 and a concrete sheathing 14 composed of one element 16 with a U-shaped section called a flue and a cover 18 formed from attached flooring (the inside of the sheathing 14 equipped with other pipes and plumbing is not shown).

Above the trench 10, on supports 20 and 22, there is a movable vessel 24 seen from the side by its "front" face (i.e., the side facing the equipment to be dismantled). The vessel 24 is shaped like a rectangular parallelepiped around 13 meters long, 5 meters wide and 4 meters high. This vessel has a self-supporting structure built around a very resistant deck 26 composed of a group of steel beams (particularly beams 25 and 27, and U-beams 29 and 31, profile views in FIG. 1) capable of supporting both lifting and handling vehicles and also large loads of earth and/or debris from the equipment to be dismantled.

The vessel 24 is moved and positioned by a moving crane (not shown) with a double set of slings in front and in back, each composed of upper slings 28 joined to the hook of the crane and kept apart by a rigid tubular control stick 30 and lower slings 32 located as illustrated in FIG. 1 between the control stick 30 and the deck 26, on each side of the vessel 24.

Moreover, the roof 34 has two pairs of vertical protective units 36 whose V-shaped end grooves are designed to hold the control sticks 30 at rest and thus protect a roof 34.

Considering the large loads to be supported, it is important to use heavy-duty vessel supports and to put them in place very carefully. As a non-limiting example, reference 22 shows a continuous concrete rail running the length of the pipes to be dismantled, and reference 20 shows a block composed of a concrete die 38 placed in the bottom of the trench or ditch 10 and a tubular steel pillar 40 whose height is adjustable. To calibrate the vessel 24 on its supports 20 and 22, wooden planks 42 are placed between the supports and the floor 26.

Figure 2:
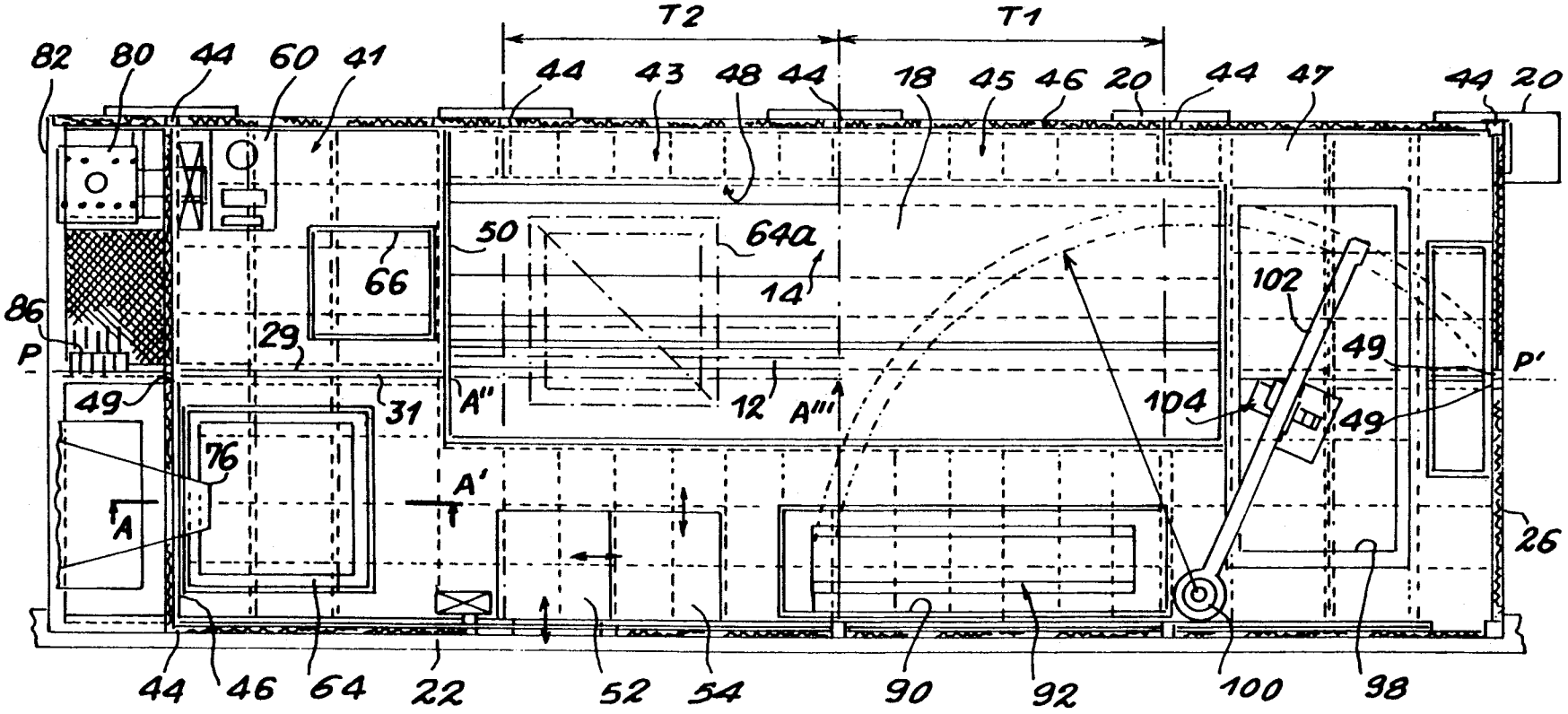
FIG. 2 represents a schematic overview (roof removed) of the vessel illustrated in FIG. 1.

FIG. 2 shows a schematic view of the top (roof removed) of the vessel 24 in the invention. Anchored on the deck 26, along each long side of the vessel are posts 44 (shown by the square sections) to define four modules 41, 43, 45 and 47 in the vessel. Moreover, each "front" and "back" side of the vessel has two twin propped posts 49 anchored on the deck 26. The posts 44 have boarding 46 that forms a rigid external envelope and the roof 34. As can be seen in FIG. 2, the blocks 20 are arranged to the right of the posts 44 to ensure good load transfer. Note that the use of the blocks is well suited for workplaces with difficult access and where the available space is limited.

The deck 26 includes a wide extended central opening 48 whose shape is mostly rectangular at the height of the modules 43 and 45 whereby occupants of the vessel 24 have access to the pipes 12 and the concrete sheathing 14. To ensure good protection and insulation from the outside, the edges of the opening 48 support four skirts 50 made of plastic sheeting lined with a double layer of vinyl (see FIGS. 1 and 3). The four skirts 50 form a static confinement, a sort of protective curtain placed around the central opening 48 to surround and insulate the work area or work zone where the section is being dismantled from the outside.

The vessel 24 is equipped with a locking chamber housed in the module 43. The locking chamber is the type with two compartments 52 and 54 made with vinyl walls mounted on tubes that permits input-output operations by operators through three doors shown schematically in FIG. 2 by three double arrows. The part of the roof opposite each module includes a high rectangular window 56 closed and sealed by a movable cover 58. The windows 56, mainly windows corresponding to the modules 41 and 47, are used to evacuate earth from the ditch and from special containers described in detail below. The entire interior of the boarding 46 is lined with a double thickness of vinyl sheeting (not shown) and ventilation in the vessel is provided by a powerful high-capacity filtering unit 60 (for example, 100 $Nm^3/h$) equipped with changeable filters suitably adapted to hold contaminated dust, inter alia. Of course, the vessel is equipped with a radio-controlled atmospheric air-sampling device.

The vessel described here as a non-limiting example of an initial embodiment of the invention has an interesting feature from the standpoint of transport from one workplace to another; more specifically, the vessel is preassembled in three subunits, which are the roof 34 and two half-shells, each composed of half of the self-supporting structure with its external boarding 46. As can be seen in FIGS. 1 and 2, the two half-shells are assembled with bolts 62 for the posts 29 and 31 and the twin posts 49, on both sides of a vertical median plane P,P'. Thus, the half shells built around the two half-decks can easily be transported using a trailer.

Figure 3:
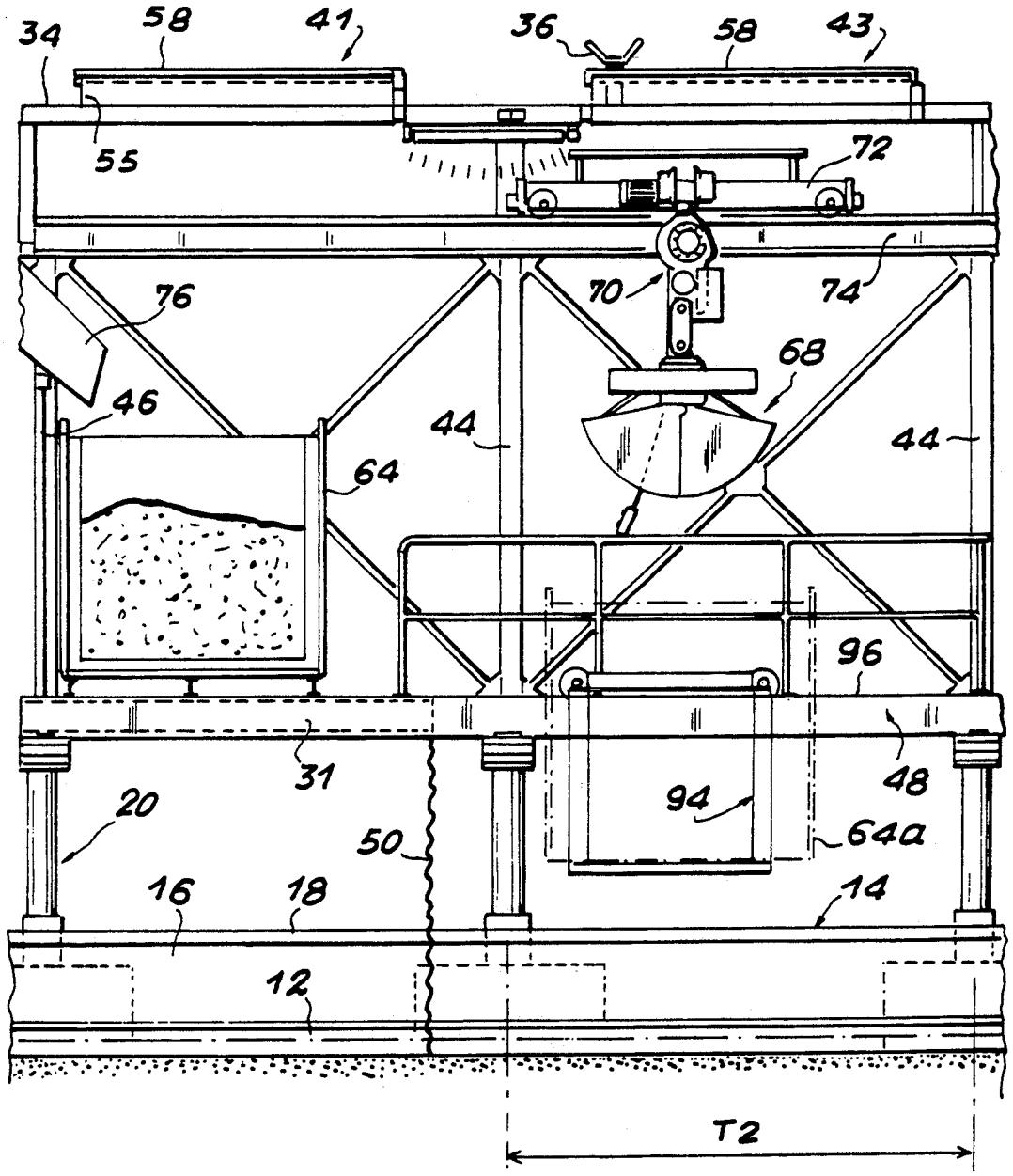
FIG. 3 represents a partial longitudinal section along the line A-A'-A''-A''' in FIG. 2 of the vessel illustrated in FIG. 1.

The inside arrangement of the vessel is shown in FIG. 2 and, partially, in FIG. 3, which details modules 41 and 43 in longitudinal section along line A,A',A'',A''' in FIG. 2. The module 41 adjacent to the "front" side of the vessel houses a holding area for a container of steel or fiber-reinforced concrete 64 designed to take the contaminated soil and a holding area 66 for temporarily storing tools, for example, a double clam-shell bucket 68 shown in FIG. 3.

The clam-shell bucket 68 is attached to a block and tackle 70 which is in turn attached to a rolling bridge 72 that can be moved on two rails 74 covering the whole inside of the vessel and supported by posts 44. The block and tackle 70 can be used in combination with the hydraulically closing clam-shell bucket 68 to clean the ditch of contaminated soil and/or to move large loads within the vessel, for example, the container 64 for the soil or pieces of the concrete sheathing 14 (in this case, the bucket 68 is placed temporarily over the area 66 composed of sheet steel whose edges are covered with a vinyl cover that can be changed). In its usual position shown in FIGS. 2 and 3, the container 64 for the soil is located under the mouth of a hopper 76 that passes through the "front" wall of the vessel. This hopper 76 whose outside entrance is controlled by a hydraulically controlled hood or helmet 78 makes it possible temporarily to store contaminated soil in the vessel dug up by the hydraulic scoop, which can move in different directions with extending arms 80 anchored on an outside face 82 of the deck 26 (in FIG. 2, only the movable base of the scoop is shown schematically as reference 80).

The scoop 80 is equipped with a clam-shell bucket 84 whose two buckets are closed with a protective sheet and a hydraulic bucket guide device 85 for precision work; the operator works from a control panel 86 located beside a regular pressurized fluid generator unit 88.

If we look again at FIG. 2, the modules 43 and 45 of the vessel are mainly occupied by the rectangular central opening 48, which, for reasons of volume gain, is shifted in relation to the symmetrical plane P,P'. However, one can see that the opening 48 is aligned on the equipment to be dismantled, i.e., the concrete sheathing 14 (of which only the cover 18 is visible in FIG. 2) and the steel pipes 12. The equipment is therefore directly accessible from inside the vessel. The module 43 houses the locking chamber with its compartments 52 and 54, while the module 45 houses a dismantling area 90 for large-sized pieces of equipment. As an example, FIG. 2 shows a specific element around 3 meters long (a flue 92) that goes with the concrete sheathing to be dismantled. This element goes with a specific section T1 being dismantled and shown by the dotted lines in FIG. 2. The temporary holding area 66 or the dismantling area 90 is composed of a sheet steel plate with the edges equipped with a vinyl sheeting that can be changed. For reasons of yield, the length of the opening 48 has been made slightly larger than two lengths of flue 92 to correspond to two specific sections to be dismantled T1 and T2. To conclude the description of the modules 43 and 45, a cart 94 suspended in the opening 48 is mounted on two rails composed of beams 96 on the deck 26 which define the two large sides of the opening 48. The cart 94 can take the container 64 for the soil 10 (as shown in 64*a* in FIGS. 2 and 3) during the ditch-cleaning phase and/or other debris at risk of contamination during the dismantling phase per se.

Module 47 basically houses a standard high-security anti-radiation container 98 made of steel provided with an internal lining of concrete placed crosswise in relation to the vessel. This container 98 is designed to take debris from equipment after dismantling. In this case, the capacity of the container allows it to store the equivalent of four three-meter sections. Module 47 also houses an adjustable bracket crane 100 whose arm 102 carries an electrical block and tackle 104 which can itself carry a certain number of tools such as hooks, self-closing pliers, hydraulic pliers, saws, etc. . . . This bracket crane 100 is specially designed to manipulate pieces of the section being dismantled for loading the container 98, either directly or after being stored in the holding area 90. To conclude, the module 47 houses a second holding area (not shown) for temporary storage of tools, composed of a sheet-steel plate whose edges are equipped with vinyl sheeting that can be changed.

As can be noted from the preceding description, the vessel is arranged so that the dismantling work can be carried out with good protection against radiation in a relatively small area. Moreover, the airspace above the equipment is largely used to dismantle and move the vessel 24 and for input-output operations of the soil-holding container 64 and the anti-radiation container 98 after release of the covers 58 of the two windows 56 corresponding to modules 41 and 47.

The process in the invention using the vessel just described is implemented as follows: the vessel is started up by putting a series of five blocks 20 in the free space at 3-meter intervals and placing the supporting rail 22 on both sides of the path of the pipes 12 and the sheath 14 to be dismantled.

As with all terracing and ditch work, the excavated earth is systematically monitored so it can be sorted according to the degree of radioactivity per unit of weight (measured, for example, in Becquerels/kg or Bq/kg). This monitoring is done by operators in protective clothing using portable counters that count the disintegration of any radioactive elements that may be present. Thus, a preliminary dig is done whose depth is determined either:

by stopping around 10 cm above the flue boards;

by exceeding a definite threshold (for example, 3700 Bq/kg) for mass activity of the soil released.

The vessel 24 is then placed above the first sections to be dismantled, using a crane, then conveniently fixed on the blocks 20 and the rail 22.

To complete insulation of the work area, the flexible vinyl curtain 50 is put in place, as well as two coffer dams in "front" and in "back" of the vessel to collect rainwater. Only water recovered in the "back" of the vessel, i.e., in the cleared area, will be pumped into the water network after monitoring.

The pipes 12 and the concrete sheathing 14 are then disengaged on site in their ditch 10 using the inside bucket 68. Contaminated soil that is active above a certain point (for example, above 3700 Ba/kg) is then stored in containers 64 covered with vinyl on the inside. The slabs that make up the covering 18 of the sheathing are monitored and stored in the bottom of the container 98. The slabs are removed along a length of 3 meters corresponding to a section T1 to be dismantled (3 meters has been chosen as the length of the section to be dismantled on the basis of the specific length of one flue). The flue thus disengaged is separated by using the block and tackle and the appropriate self-closing pliers to lift a debris recovery sheet covered with a vinyl film and allow it to be placed in the bottom of the trench 10. Optionally, the walls of the flue can be pierced to make it easier to get hold of it.

The flue 16 is then detached by cutting with a circular saw at the cement joint between the flues. If need be, the flue is cut using a hydraulic hammer. Then, the elements of the flue are cut, like the plastic pipes, and this debris is stored temporarily in the cart 94. It is possible, for this purpose, to use a basket (not shown) instead of the container 64. The flue 16 is then removed from its ditch and placed in the holding area 90 for monitoring. Depending on the degree of radioactivity, the flue will be either evacuated through the roof of the vessel directly or if contamination is detected (exceeding a set threshold of mass radioactivity, for example 3700 Bq/kg), placed in the anti-radiation container 98.

The metal pipes 12 are then taken out by 3-meter section according to the same principle, with prior installation of a recovery plate for the saw debris. The sections sawed are also placed in the anti-radiation container 98. When the container 98 is full, it is evacuated from the vessel by crane through the roof 34, then sent to an appropriate storage area. In the example of implementation of the process according to the invention described here, an anti-radiation container makes it possible to evacuate the debris from dismantling four, 3-meter sections. As a variation, it is possible to have a place to cut the flue in pieces using appropriate tools, for example hydraulic pliers that can burst the walls of the flue.

Finally, the ditch per se (soil and walls) is monitored. If the mass activity measured is below an initial threshold determined (for example, 37 Bq/kg), the area and the evacuated soil are considered healthy and inactive. If the mass activity is above this initial threshold and below a second threshold set (for example 3700 Bq/kg), the doubtful soil is removed with buckets and transported to a monitored dump. Lastly, if the mass activity is above this second threshold, the contaminated soil will be removed by one of the buckets and stored in the soil holding container 64. If an outside bucket is used, the contaminated soil is sent into the container 64 by the hopper 76.

The second section T2 is then dismantled as described above. Meanwhile, the outside bucket 84 is used for terracing, which permits the next sections to be disengaged and the blocks 20 to be set at 3-meter intervals (the extracted soil is monitored and sorted as described previously).

After monitoring and evacuating the rainwater, it is then possible to move the vessel by crane.

Figure 4:
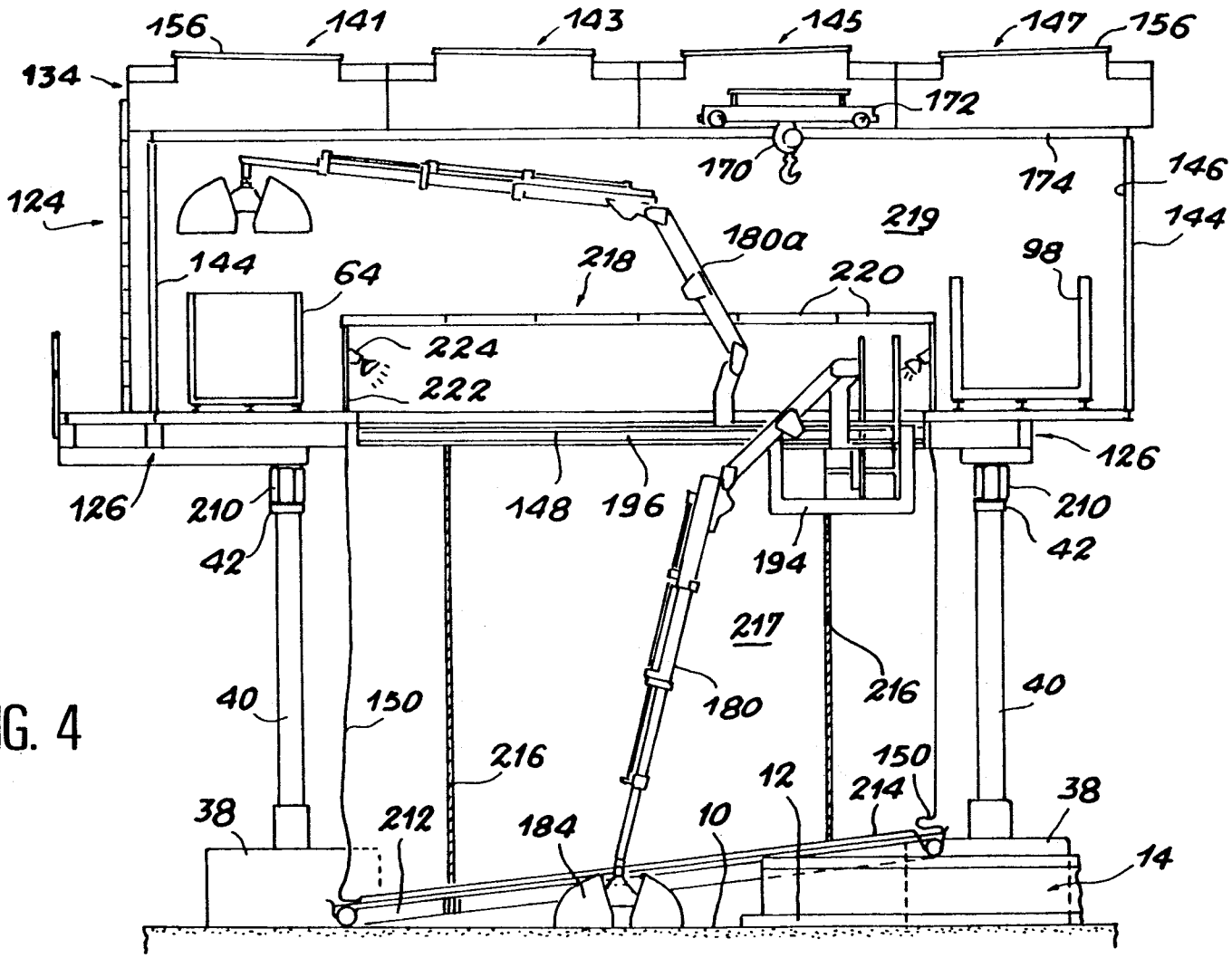
FIG. 4 represents a longitudinal section of a second embodiment of a vessel according to the invention.

The vessel illustrated in FIG. 4 shows another embodiment of a vessel according to the invention. This vessel, similar in structure to that of the vessel already described with reference to FIGS. 1 to 3, will not be described completely in detail. In particular, the similar or equivalent elements in the two vessels will have the same reference numbers, plus 100. Only technical changes and/or additions made to the vessel in FIG. 4 will be described in detail. Generally speaking, the changes and/or additions are aimed at further improving protection from contamination during dismantling operations.

Looking at FIG. 4, the vessel in the invention 124 (shown in median longitudinal cross section) includes a reinforced deck 126 supported by pillars 40, 42 through support cross beams 210 (shown in transverse section). This arrangement makes it possible to increase the spacing between the pillars 40. As a variation, the support cross beams are placed on longitudinal girders (not shown) set up on each side of the ditch. The deck 126 has a central opening 148 bordered by two beams 196 serving as rails for the cart 194. This cart 194 has also been reinforced to carry an extended hydraulic scoop 180 whose buckets 184 can be moved and replaced during certain operations with other suitable tools. The scoop 180 can thus move with the cart 194 in the opening 148 to place soil taken from the bottom of the ditch 10 in the container 64 (reference 180*a* shows the scoop in another working position).

As before, the steel-concrete container 98 is placed at the other end of the vessel 124 and evacuated through the window 156 of the section 147.

The flexible protective curtain 150, designed to insulate the working zone in the ditch from the outside, is composed of a thick vinyl bellows, one end of which is joined to the edge of the central opening 148 and the other end of which has a rigid frame 212 equipped with a gutter for taking the bellows when it is retracted (curtain raised). The curtain 150 is manuevered in extended or retracted position (curtain lowered or raised) by a lifting device with a winch, of which only the maneuvering belts 216 are seen in FIG. 4. To complete the protection against contamination, the curtain 150 is lined on the inside with a double thickness of vinyl (not shown).

In the way already shown for vessel 24, vessel 124 has a rigid outside envelope composed of posts 144 and boarding 146 lined with vinyl and a roof 134 equipped with windows 156. The posts 144 support the two rails 174 on which a rolling bridge 172 carrying a block and tackle 170, can move. Moreover, the vessel 124 has a dual locking-room system (not shown) similar to the one (52, 54) described in reference to the vessel 24. Generally, the plane that the floor 126 occupies is (unless specified otherwise) pretty much identical to the one of the floor 26 of the vessel 24 illustrated in FIG. 2. Moreover, the vessel 124 is also assembled from two half shells bolted according to the arrangement described for the vessel 24.

The work zone or work area 217 of the ditch 10, in which the section being dismantled is located, is insulated for a time from the outside 219 of the vessel 124 by a movable internal hood 218 covering the central opening 148 and composed of panels 220 made of aluminum covered with vinyl protection and placed on an internal partition 222 surrounding the opening 148. This partition 222 has lighting 224.

The contaminated dust is collected by two separate ambient air purification systems in the vessel 124 and in the work area each with its own battery of filters located inside the vessel. The systems, which are not shown in FIG. 4, are composed of a forced ventilation system similar to the one described under reference 60 for the vessel 24 and a moving-head vacuum system that can be placed in the immediate neighborhood of the elements being dismantled (concrete sheathing 14 or pipes 12).

These purification systems have an average air flow of around 100 $Nm^3/h$. Their working features are such that when the moving head 218 is in place (hood closed), the work area 217 is depressed in relation to the inside of the vessel 219, which is itself depressed in relation to the outside (atmospheric air).

The implementation of the process in the invention with the vessel 124 is similar to the one described with the vessel 24. However, the hood 218 permits improved confinement of the contaminated debris and increased protection for the occupants of the vessel. Generally, as much dismantling work as possible is done when the inside hood/cover 218 is in place on the partition 222 to serve as insulation. This is true for cutting and preconditioning the debris from the pipes, slabs and flue under vinyl.

Of course, the invention is not limited by the linear nature of the equipment to be dismantled, here described as examples; in particular, the process in the invention can be used for dismantling other types of structures, and the vessel may be adapted to the specifics of the worksite.

We claim:

1. An installation for dismantling buried, unsheltered equipment in a radioactive-contaminated area, said vessel comprising:

support means adapted to rest on the soil in the vicinity of said equipment to be dismantled;

a movable vessel forming a self-supporting structure, adapted to rest on said support means, said vessel including a deck having a central opening, and an outside envelope including at least one locking chamber and at least one window with a movable hood;

at least one container adapted to be received within the vessel through said window;

handling means for extracting soil around the equipment, dismantling said equipment, transferring the extracted soil and dismantled equipment into said container, and transferring the container between the inside of the vessel and the outside through said window;

a flexible protection curtain supported by edges of the central opening in order to surround and insulate from the outside a work zone located above said equipment and communicating with the inside of the vessel through the central opening; and a first forced ventilation system including filter means and ensuring a dynamic confinement of the inside of the vessel.

2. The installation of claim 1, further comprising a movable inside cover to close the central opening and insulate the inside of the vessel from the work zone.

3. The installation of claim 2, further comprising a second forced ventilation system to ensure a dynamic confinement of the work zone, the first forced ventilation system establishing within said vessel a pressure below the atmosphere pressure and the second forced ventilation system establishing within said work zone, when insulated from the inside of the vessel by said movable inside cover, a pressure below the pressure within said vessel.

4. The installation of claim 1, further comprising a vacuum filter device having a moving head located within said work zone.

5. The installation of claim 1, wherein the flexible protection curtain comprises a bellows having one end joined to the edges of the central opening and another end joined to a rigid frame adapted to receive said bellows when the latter is retracted.

6. The installation of claim 5, further comprising a winch lifting device for moving said bellows between an extended and a retracted position.

7. The installation of claim 1, wherein the deck of the movable vessel includes at least one holding area for said container and at least one dismantling area.

8. The installation of claim 7, further comprising a hopper, normally closed by a controlled opening helmet, extending through said outside envelope and opening above said holding area.

9. The installation of claim 8, wherein the deck comprises an extension outside said vessel on which are received first soil handling means adapted to open a trench around a section of said equipment which is not located below the vessel and to transfer the soil removed from the trench into a container received on said holding area through said hopper.

10. The installation of claim 1, wherein the outside envelope of the vessel includes a roof in which is located said window.

11. The installation of claim 1, wherein the central opening has two opposite sides forming a path for a cart suspended in said central opening.

12. The installation of claim 11, wherein the cart carries a second handling means.

13. The installation of claim 1, wherein the outside envelope of the movable vessel comprises three preassembled subunits including a roof and two half-shells, the latter being normally interconnected by removable connecting means along a vertical median plane parallel to largest sides of the deck.

14. The installation of claim 1, adapted for dismantling equipment having a generally linear shape, wherein the central opening of the deck has a rectangular shape.

15. The installation of claim 1, characterized in that the handling means comprise a rolling bridge mounted within the movable vessel, tackle means attached to the rolling bridge, and a clam-shell bucket adapted to be carried by the tackle means and to be received on a dismantling area provided on the deck.

* * * * *